US009732588B2

(12) United States Patent
Fripp et al.

(10) Patent No.: US 9,732,588 B2
(45) Date of Patent: Aug. 15, 2017

(54) ACTUATION ASSEMBLY USING PRESSURE DELAY

(71) Applicant: HALLIBURTON ENERGY SERVICES, INC., Houston, TX (US)

(72) Inventors: Michael Linley Fripp, Carrollton, TX (US); James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 197 days.

(21) Appl. No.: 14/391,075

(22) PCT Filed: Dec. 6, 2013

(86) PCT No.: PCT/US2013/073516
§ 371 (c)(1),
(2) Date: Oct. 7, 2014

(87) PCT Pub. No.: WO2015/084389
PCT Pub. Date: Jun. 11, 2015

(65) Prior Publication Data
US 2016/0258252 A1 Sep. 8, 2016

(51) Int. Cl.
*E21B 34/14* (2006.01)
*E21B 34/10* (2006.01)
(Continued)

(52) U.S. Cl.
CPC ..... *E21B 34/14* (2013.01); *E21B 34/10* (2013.01); *E21B 34/108* (2013.01); *E21B 41/00* (2013.01); *E21B 2034/007* (2013.01)

(58) Field of Classification Search
CPC ..... E21B 34/14; E21B 34/10; E21B 34/0007; E21B 34/108; E21B 2034/007
See application file for complete search history.

(56) References Cited

U.S. PATENT DOCUMENTS 5,050,681 A * 9/1991 Skinner ..... E21B 34/066 166/319
6,321,847 B1 11/2001 Brown
(Continued)

FOREIGN PATENT DOCUMENTS

WO 0123702 4/2001

OTHER PUBLICATIONS

PCT/US2013/073516 , "Actuation Assembly Using Pressure Delay", International Search Report / Written Opinion, Sep. 2, 2014, 11 pages.

*Primary Examiner* — Brad Harcourt
(74) *Attorney, Agent, or Firm* — Kilpatrick Townsend & Stockton LLP

(57) ABSTRACT

A downhole assembly for tool actuation using pressure delay is provided. The downhole assembly can include a chamber, a pressure path, a pressure damper, a pressure source, and a member. The pressure path can be positioned between first and second ends of the chamber. The pressure damper can reduce a rate at which pressure is communicated in the pressure path. Pressure from the pressure source can be communicated to the first end of the chamber and the second end of the chamber at different rates. The member can be positioned in the chamber between the first end and the second end. The member can actuate a downhole tool in response to a pressure difference between the first end and the second end. The pressure difference can result from a difference in between the first rate and the second rate.

14 Claims, 4 Drawing Sheets

(51) Int. Cl.
*E21B 41/00* (2006.01)
*E21B 34/00* (2006.01)

(56) References Cited

U.S. PATENT DOCUMENTS

| | | | |
|---|---|---|---|
| 7,201,230 | B2 | 4/2007 | Schultz et al. |
| 2002/0014338 | A1 | 2/2002 | Purkis et al. |
| 2002/0050354 | A1 | 5/2002 | Schultz et al. |
| 2011/0155393 | A1 | 6/2011 | Loretz et al. |
| 2013/0092396 | A1 | 4/2013 | Webber et al. |

* cited by examiner

ACTUATION ASSEMBLY USING PRESSURE DELAY

CROSS-REFERENCE TO RELATED APPLICATIONS

This is a U.S. national phase under 35 U.S.C. 371 of International Patent Application No. PCT/US2013/073516, titled "Actuation Assembly Using Pressure Delay" and filed Dec. 6, 2013, the entirety of which is incorporated herein by reference.

TECHNICAL FIELD

The present disclosure relates generally to devices for use in a wellbore in a subterranean formation and, more particularly (although not necessarily exclusively), to actuation assemblies for actuating downhole tools using a pressure delay.

BACKGROUND

Various devices can be installed in a well traversing a hydrocarbon-bearing subterranean formation. Several devices can be actuated within the well in order to perform specific functions. Prior solutions for actuating devices positioned in a wellbore may include assemblies having multiple components or using multiple control lines in the wellbore. Such solutions may increase the cost or complexity (or both) of actuating downhole tools.

Simplified mechanisms for actuating downhole tools are desirable.

DETAILED DESCRIPTION

Certain aspects of the present disclosure are directed to tools actuated by pressure delay. Pressure delay tools can actuate downhole tools via the application of pressure at different rates to different portions of a pressure delay actuation assembly. Pressure can be applied to a first portion of the pressure delay actuation assembly at a higher or faster rate than the rate at which pressure is applied to a second portion of the pressure delay actuation assembly. The different rates of pressure application can delay pressure communication to the second portion. Delaying pressure communication to the second portion of the pressure delay actuation assembly can allow a pressure in the first portion of the tool to become higher than a pressure in the second portion of the tool. The pressure differential between the first portion and the second portion can actuate the pressure delay actuation assembly or a tool coupled with the pressure delay actuation assembly.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "left," "right," "upward," and "downward," etc. in relation to the illustrative aspects as they are depicted in the figures, the upward direction being toward the top of the corresponding figure, the downward direction being toward the bottom of the corresponding figure, the left direction being toward the left of the corresponding figure, and the right direction being toward the right of the corresponding figure. Like the illustrative aspects, the numerals and directional descriptions included in the following sections should not be used to limit the present disclosure.

Figure 1:
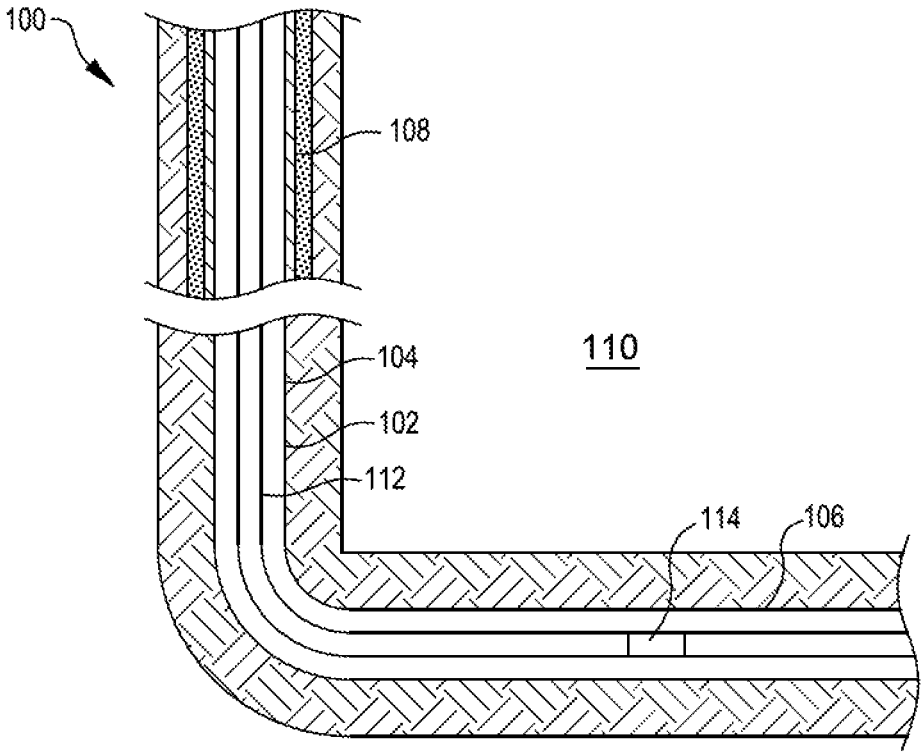
FIG. 1 is a schematic diagram of a well system having a pressure delay actuation assembly according to one aspect of the present disclosure.

FIG. 1 schematically depicts an example of a well system 100 having a tubing string 112 with an actuation assembly 114 using pressure delay for actuating downhole tools. In various aspects, the pressure delay actuation assembly 114 can actuate one or more downhole tools positioned in the well system 100. The well system 100 can include one or more pressure delay actuation assemblies 114. The well system 100 includes a bore that is a wellbore 102 extending through various earth strata. The wellbore 102 has a substantially vertical section 104 and a substantially horizontal section 106. The substantially vertical section 104 and the substantially horizontal section 106 can include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

Although FIG. 1 depicts the pressure delay actuation assembly 114 in the substantially horizontal section 106, the pressure delay actuation assembly 114 can be located, additionally or alternatively, in the substantially vertical section 104. In some aspects, the pressure delay actuation assembly 114 can be disposed in simpler wellbores, such as wellbores having only a substantially vertical section. The pressure delay actuation assembly 114 can be disposed in openhole environments, as depicted in FIG. 1, or in cased wells. In some aspects, the pressure delay actuation assembly can be disposed in an injection well.

Figure 2:
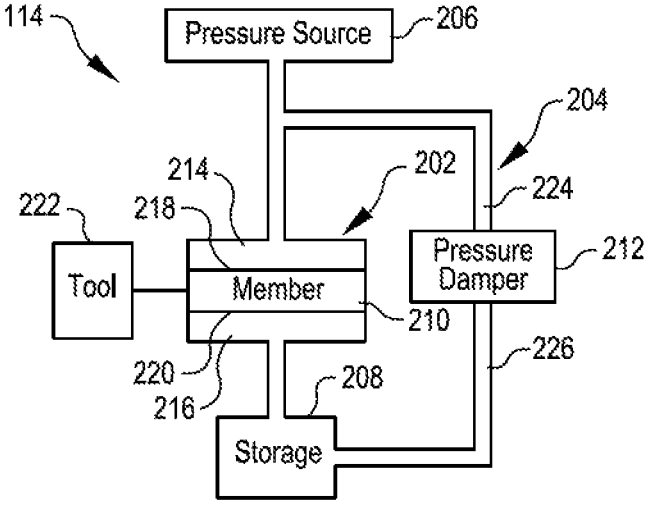
FIG. 2 is a schematic diagram of a pressure delay actuation assembly according to one aspect of the present disclosure.

FIG. 2 is a schematic diagram of a pressure delay actuation assembly 114 according to one aspect. The pressure delay actuation assembly 114 can include a chamber 202, a pressure path 204, a pressure source 206, an energy storage device 208, and a member 210.

The member 210 can be positioned in the chamber 202. The chamber 202 can have a first end 214 and a second end 216. The member 210 may provide a barrier between the first end 214 of the chamber 202 and the second end 216 of the chamber 202. The first end 214 of the chamber 202 can have a different pressure than the second end 216 of the chamber 202. A first end 218 of the member 210 can be exposed to the first end 214 of the chamber 202. A pressure in the first end 214 can be exerted on the first end 218 of the member 210. The second end 220 of the member 210 can be exposed to the second end 216 of the chamber 202. A pressure in the second end 216 of the chamber 202 can be exerted on the second end 220 of the member 210. Non-limiting examples of the member 210 include a piston, a baffle, and a sliding sleeve.

The member 210 can be coupled with a tool 222. Movement of the member 210 can cause the tool 222 to actuate. Non-limiting examples of the tool 222 include a safety valve and a sliding sleeve.

The pressure path 204 can allow fluid communication between the first end 214 of the chamber 202 and the second end 216 of the chamber 202. For example, the pressure path may provide a pressure path for pressurized fluid. The pressure path 204 can include a pressure damper 212. The pressure damper 212 can reduce a rate at which pressure is communicated through the pressure path 204. For example, the pressure damper 212 may limit the rate at which fluid is permitted to flow through the pressure path 204. Non-limiting examples of the pressure damper 212 include a diameter restriction, a weep valve, a fluidic diode, a portion of the pressure path 204 having a rough surface, a vortex, a moving piston, a bellows, or some combination thereof. Examples of the pressure damper 212 are discussed in greater detail below.

The energy storage device 208 can store energy in response to pressure being communicated to the second end 216 of the chamber 202 by the pressure path 204. Non-limiting examples of the energy storage device 208 include an accumulator, a piston biased by one or more springs, a dual spring piston assembly, an air chamber, a tube swelling chamber, a bladder membrane, or some combination thereof. Examples of the energy storage device 208 are discussed in greater detail below.

The pressure source 206 can be in fluid communication with the first end 214 of the chamber 202, the second end 216 of the chamber 202, the energy storage device 208, or some combination thereof. Fluid can be communicated from the pressure source 206 via the pressure path 204 or by one or more other intervening structures. Examples of intervening structures include the first end 214 of the chamber 202, the second end 216 of the chamber 202, and the energy storage device 208. Non-limiting examples of the pressure source 206 include a control line, pressure within a tubing string 112, and pressure in an annulus between the tubing 112 and the formation 110. In some aspects, the pressure source 206 may provide a level of pressure correlated to a hydrostatic pressure. The hydrostatic pressure may be based on a depth at which the pressure delay actuation assembly 114 is positioned within the wellbore 102. Examples of the pressure source 206 are discussed in greater detail below.

An increase in pressure at the first end 214 of the chamber 202 (e.g., from the pressure source 206) can be communicated to the second end 216 of the chamber 202 via the pressure path 204. The pressure damper 212 can cause the rate at which the pressure is communicated to the second end 216 of the chamber 202 to be different from a rate at which a pressure is communicated to the first end 214 of the chamber 202. Communicating pressure to the first end 214 of the chamber 202 at a greater rate than a pressure communicated to the second end 216 of the chamber 202 can cause the pressure in the first end 214 of the chamber 202 to become higher than a pressure in the second end 216 of the chamber 202. The difference in pressure between the higher pressure in the first end 214 of the chamber 202 and the lower pressure in the second end 216 of the chamber 202 can cause the member 210 to move downward. Movement of the member 210 in the downward direction can actuate the tool 222 that is coupled with the member 210.

The pressure being communicated to the second end 216 of the chamber 202 can cause the pressure in the second end 216 of the chamber 202 to eventually become equal to the raised pressure in the first end 214 of the chamber 202. The equal pressure in the first end 214 of the chamber 202 and in the second end 216 of the chamber 202 can retain the member 210 in a downward position. Friction between the member 210 and walls of the chamber 202 can impede motion of the member 210 in the absence of a pressure differential between the first end 214 and the second end 216 of the chamber 202. The member 210 can be retained in the downward position in the absence of a change in pressure from the pressure source 206. The increase in pressure communicated to the second end 216 of the chamber 202 can also cause energy to be stored by the energy storage device 208.

A drop in pressure from the pressure source 206 can reduce pressure at the first end 214 of the chamber 202 and a first end 224 of the pressure damper 212. The pressure drop at the first end 224 of the pressure damper 212 can cause a pressure at the first end 224 of the pressure damper 212 to be lower than a pressure at a second end 226 of the pressure damper 212. The pressure difference across the pressure damper 212 can cause pressure to be communicated at a controlled rate from the second end 226 of the pressure damper 212 to the first end 224 of the pressure damper 212. The pressure drop communicated from the pressure source 206 to the first end 214 of the chamber 202 can cause a pressure in the first end 214 of chamber 202 to be less than a pressure in the second end 216 of the chamber 202. The energy stored in the energy storage device 208 can provide the higher pressure in the second end 216 of the chamber 202. The difference in pressure between the greater pressure in the second end 216 of the chamber 202 and the lower pressure in the first end 214 of the chamber 202 can cause the member 210 to move upward. Upward movement of the member 210 can cause the tool 222 to actuate.

The higher pressure in the second end 216 of the chamber 202 or in the energy storage device 208 (or both) can be communicated through the pressure damper 212. The pressure damper 212 can slow a change of pressure in the second end 216 of the chamber 202 or in the energy storage device 208 (or both). Communication through the pressure damper 212 can cause pressure in the second end 216 of the chamber 202 or in the energy storage device 208 (or both) to decrease. The decrease in pressure can cause the pressure in the first end 214 and the second end 216 of the chamber 202 to become equal. The equal pressure in the first end 214 of the chamber 202 and in the second end 216 of the chamber 202 can retain the member 210 in an upward position in the absence of a change in pressure from the pressure source 206.

Figure 3:
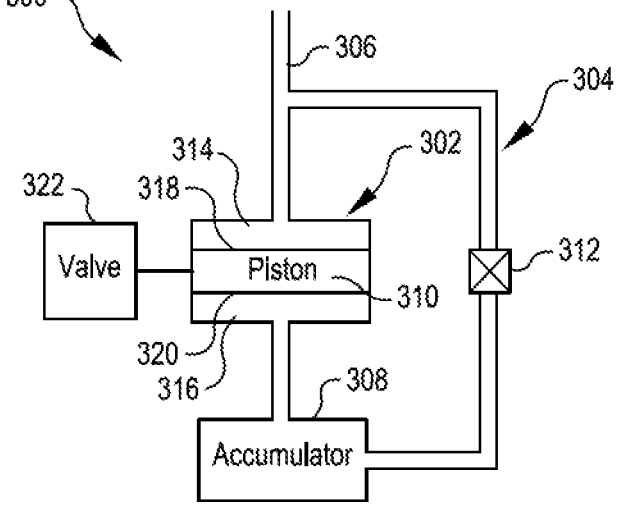
FIG. 3 is a schematic diagram of an example of a pressure delay actuation assembly having an accumulator in accordance with one aspect of the present disclosure.
Figure 4:
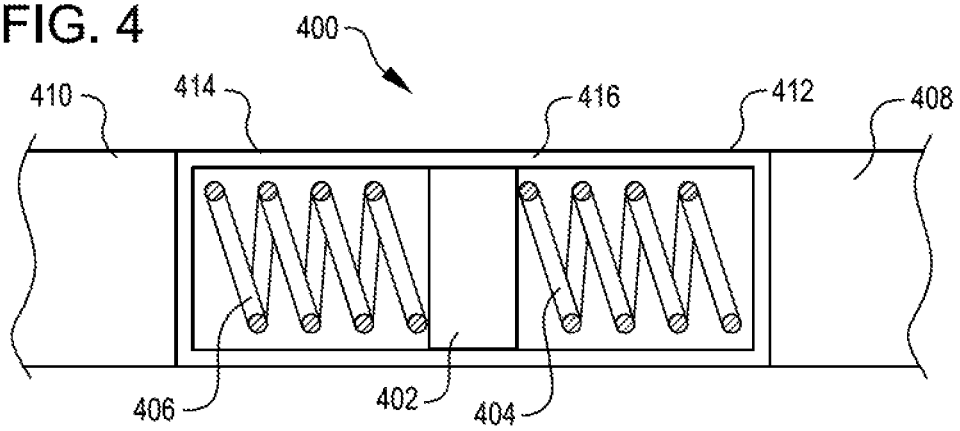
FIG. 4 is a schematic diagram of a two-spring device according to one aspect of the present disclosure.
Figure 5:
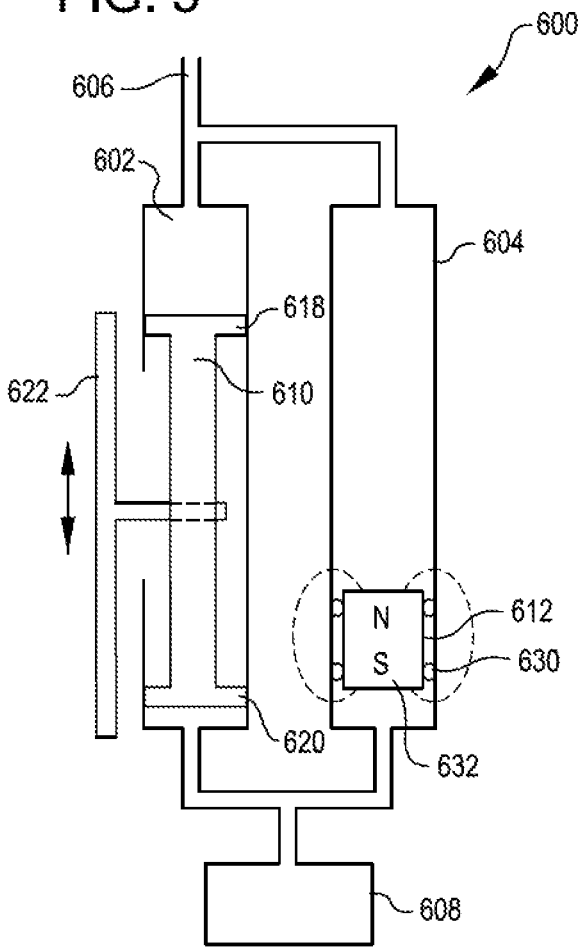
FIG. 5 is a schematic diagram of a pressure delay actuation assembly with a piston for restricting a rate of pressure communication according to one aspect of the present disclosure.

FIGS. 3-5 depict additional features and examples of a pressure delay actuation assembly 114. FIG. 3 is a schematic diagram of an example of a pressure delay actuation assembly 300 using an accumulator 308 as an energy storage device 208 in accordance with one aspect. The pressure delay actuation assembly 300 can include a control line 306, a piston 310, a weep valve 312, and an accumulator 308. The pressure delay actuation assembly 300 can actuate a valve 322 associated with the piston 310.

The control line 306 can communicate a pressure to the first end 314 of the chamber 302. The pressure communicated to the first end 314 of the chamber 302 can be exerted on a first end 318 of the piston 310 positioned in the chamber 302. The pressure from the control line 306 can also be communicated to a second end 316 of the chamber 302 via the pressure path 304. The pressure path 304 may include the weep valve 312. The weep valve 312 may reduce a rate at which pressure from the control line 306 is communicated to the second end 316 of the chamber 302. For example, the weep valve 312 may allow a smaller amount of fluid at a time to pass through the portion of the pressure path 304 including the weep valve 312 than other portions of the pressure path 304. Reducing the rate at which the pressure from the control line 306 is communicated to the second end 316 of the chamber 202 can cause the first end 314 of the chamber 202 to have a higher pressure than the second end 316 of the chamber 302. The difference in pressure between the higher pressure in the first end 314 and the lower pressure in the second end 316 can cause the piston 310 to move downward. The piston 310 can be connected to the valve 322 such that movement of the piston 310 downward causes the valve 322 to open or move toward an open position.

The pressure communicated from the control line 306 to the second end 316 of the chamber 302 can increase the pressure in the second end 316 of the chamber 302. The pressure in the second end 316 of the chamber 302 can eventually reach a pressure equivalent with the pressure in the first end 314 of the chamber 302. The pressure communicated from the control line 306 via the weep valve 312 can cause fluid to flow into the accumulator 308. Fluid flowing into the accumulator 308 can increase a level of pressure in the accumulator 308. The increased pressure in the accumulator 308 can provide a stored energy in the accumulator 308.

Pressure communicated by the control line 306 can be decreased. For example, the control line 306 may be operated to provide a lower pressure or a leak may occur, causing a pressure from the control line 306 to decrease. A pressure decrease in the control line 306 can communicate a pressure decrease to the first end 314 of the chamber 302. The energy stored in the pressurized fluid in the accumulator 308 can cause a pressure level in the second end 316 of the chamber 302 to be higher than a pressure level in the first end 314 of the chamber 302. The difference in pressures can cause the piston 310 to move upward. Upward movement of the piston 310 can cause the valve 322 connected to the piston 310 to close or move toward a closed position. The accumulator 308 can reduce a rate at which pressure is communicated from the second end 316 of the chamber 302 through the pressure path 304. Communicating pressure from the second end 316 of the chamber 302 through the pressure path 304 can reduce the level of pressure in the second end 316 of the chamber 302. The pressure in the second end 316 of the chamber 302 can eventually reach a pressure equivalent with the lower pressure in the first end 314 of the chamber 302.

FIG. 4 is a schematic diagram of a two-spring device 400 according to one aspect. The two-spring device 400 can be utilized in place of an accumulator 308, i.e., as an energy storage device 208. In one example, the two-spring device 400 can be positioned between the pressure damper 212 and the second end 216 of the chamber 202 depicted in FIG. 2.

The two-spring device 400 can include a piston 402, a first spring 404, a second spring 406, and spring chamber 416. The spring chamber 416 can have a first end 412 and a second end 414. The first end 412 of the spring chamber 416 can be coupled with a first pressure volume 408. For example, the first pressure volume 408 can correspond to the second end 226 of the fluid damper 212 depicted in FIG. 2. The second end 414 of the spring chamber 416 can be in fluid communication with a second pressure volume 410. For example, the second pressure volume 410 can correspond to a second end 216 of the chamber 202 depicted in FIG. 2. The piston 402 can be positioned in the spring chamber 416 between the first end 412 and the second end 414. The first spring 404 can be positioned at a first end 412 of the chamber 416. The second spring 406 can be positioned at a second end 414 of the chamber 416.

A pressure increase communicated by the first pressure volume 408 to the first end 412 of the spring chamber 416 can cause the pressure in the first end 412 to exceed the pressure in the second end 414. The pressure difference can cause the piston 402 to move toward the left and compress the second spring 406. Movement of the piston 402 can communicate the increased pressure of the first pressure volume 408 to the second pressure volume 410. The second spring 406 can provide a supplemental force to move the member 402 toward the right in the case of a pressure decrease in the first pressure volume 408.

A pressure decrease communicated by the first pressure volume 408 to the first end 412 of the spring chamber 416 can cause the pressure in the first end 412 to be less than the pressure in the second end 414. The pressure difference can cause the piston 402 to move toward the right and compress the first spring 404. Movement of the piston 402 can bleed the greater pressure of the second pressure volume 410 into the first pressure volume 408. The first spring 404 can provide a supplemental force to move the member 402 toward the left in the case of a pressure decrease in the second pressure volume 410.

FIG. 5 is a schematic diagram of a pressure delay actuation assembly 600 with a damping piston 612 for restricting a rate of pressure communication according to one aspect. The pressure delay actuation assembly 600 can include a pressure source 606, a chamber 602, a pressure path 604, a damping piston 612, an accumulator 608, a piston 610, and a shift valve 622.

The damping piston 612 can be positioned in the pressure path 604. Pressure communicated from the pressure source 606 into the pressure path 604 can exert a force on the damping piston 612. The damping piston 612 can move in response to the force. One or more dissipative forces between the damping piston 612 and the pressure path 604 can resist the movement of the piston 612. In one example, friction between the damping piston 612 and the pressure path 604 can slow the movement of the damping piston 612. The damping piston 612 may include O-rings 630 positioned between the damping piston 612 and the pressure path 604. The O-rings 630 can provide a friction surface between the damping piston 612 and the pressure path 604.

Another example of a dissipative force can include a magnetic force. In some aspects, the damping piston 612 can include magnets 632. The magnets 632 can produce a magnetic field that causes eddy currents in the fluid communicated in the pressure path 604. The eddy currents can slow movement of the damping piston 612.

The damping piston 612 can limit an amount of fluid that can be communicated to an accumulator 608. Limiting the amount of fluid that can be communicated to an accumulator 608 can prevent the accumulator 608 from reaching a threshold pressure level. For example, a threshold pressure level may be a pressure level at which the accumulator 608 may rupture or otherwise be damaged. In some aspects, the damper piston 612 can also allow the accumulator 608 to be charged with a compressible fluid (such as nitrogen gas or carbon dioxide gas) at a surface of the well system 100.

Downward movement of the damping piston 612 can communicate pressure to a second end 620 of the piston 610 at a slower rate than a rate at which pressure is communicated from the pressure source 606 to a first end 618 of the piston 610. The difference in pressure rates can cause a higher pressure to be exerted on the first end 618 in comparison to a pressure exerted on the second end 620. The pressure difference can cause the piston 610 to move downward. Downward movement of the piston 610 can open the shift valve 622 connected with the piston 610.

Properly charging the accumulator 608 can allow the pressure delay actuation assembly 600 to reset the shift valve 622 in response to a cessation or reduction of pressure communicated from pressure source 606. Downward movement of the damping piston 612 can also cause pressure in the accumulator 608 to increase. If a reduction in pressure is communicated from the pressure source 606, the increased pressure in the accumulator 608 can provide pressure for pushing the damping piston 612 and the piston 610 in an upward direction. The damping piston 612 can move upward more slowly than the piston 610 in response to the pressure in the accumulator 608. The difference in the rate of movement between the piston 610 and the damping piston 612 can allow the piston 610 to move the shift valve 622 to a fully open position before the pressure in the accumulator 608 is depleted by movement of the damping piston 612.

Figure 6:
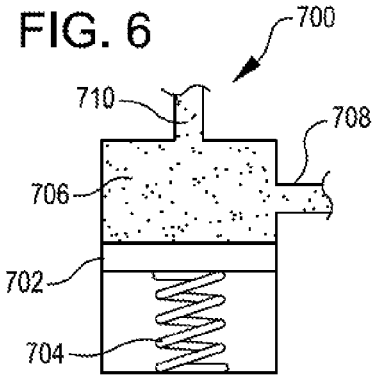
FIGS. 6-7 are schematic diagrams of a spring-piston device for a pressure delay actuation assembly according to one aspect of the present disclosure.
Figure 7:
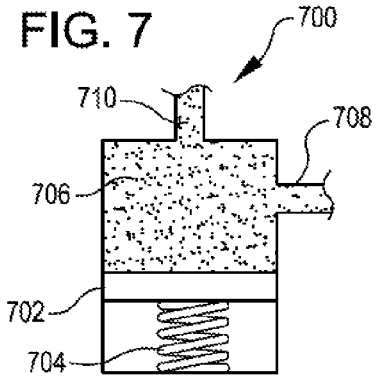

FIGS. 6-7 are schematic diagrams of a spring-piston device 700 for a pressure delay actuation assembly 701 according to one aspect. The spring-piston device 700 can be used as the energy storage device 208 discussed above with respect to FIG. 2. The spring-piston device 700 can include a piston 702, a spring 704, a compartment 706, a first port 708 and a second port 710.

The piston 702 can be positioned in the compartment 706. The piston 702 can be coupled with the spring 704. The first port 708 can provide fluid communication between the compartment 706 and the pressure path 204. The second port 710 can provide fluid communication between the compartment 706 and the second end 216 of the chamber 202.

Pressure can be communicated from the pressure source 206 to the compartment 706 via the pressure path 204 and the first port 708. The pressure can move the piston 702 downward (e.g., from the position depicted in FIG. 6 to the position depicted in FIG. 7). Downward movement of the piston 702 can cause the spring 704 to compress. Compression of the spring 704 can store energy in the spring 704. The energy stored in the spring 704 can cause the piston 702 to move in an upward direction (e.g., from the position depicted in FIG. 7 to the position depicted in FIG. 6) in response to pressure from the pressure source 206 being reduced. Upward movement of the piston 702 can increase pressure in the compartment 706. The pressure can be communicated to the second end 216 of the chamber 202 via the second port 710. The pressure provided by the spring-piston device 700 can provide pressure to the second end 216 of the chamber 202 for actuating the tool 222.

Figure 8:
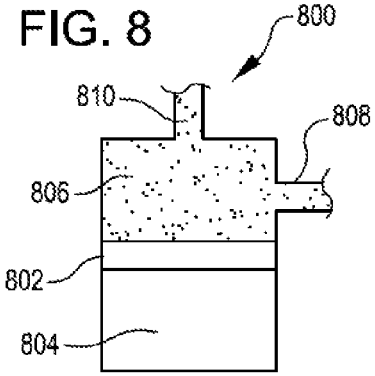
FIGS. 8-9 are schematic diagrams of an air chamber device for a pressure delay actuation assembly according to one aspect of the present disclosure.
Figure 9:
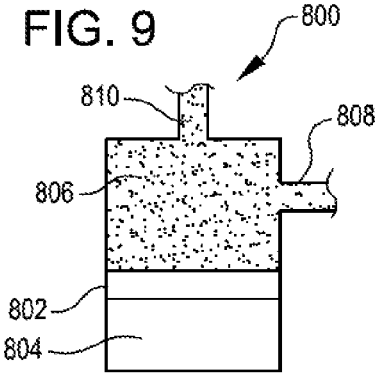

FIGS. 8-9 are schematic diagrams of an air chamber device 800 for a pressure delay actuation assembly 801 according to one aspect. The air chamber device 800 can be used as the energy storage device 208 discussed above with respect to FIG. 2. The air chamber device 800 can include a piston 802, an air chamber 804, a compartment 806, a first port 808 and a second port 810.

The piston 802 can be positioned in the compartment 806. The piston 802 can be positioned adjacent to the air chamber 804. The first port 808 can provide fluid communication between the compartment 806 and the pressure path 204. The second port 810 can provide fluid communication between the compartment 806 and the second end 216 of the chamber 202.

Pressure can be communicated from the pressure source 206 to the compartment 806 via the pressure path 204 and the first port 808. The pressure can move the piston 802 downward (e.g., from the position depicted in FIG. 8 to the position depicted in FIG. 9). Downward movement of the piston 802 can reduce a volume of the air chamber 804 and increase a pressure in the air chamber 804. Increasing a pressure in the air chamber 804 can store energy in the air chamber 804. The energy stored in the air chamber 804 can cause the piston 802 to move in an upward direction (e.g., from the position depicted in FIG. 9 to the position depicted in FIG. 8) in response to pressure from the pressure source 206 being reduced. Upward movement of the piston 802 can increase pressure in the compartment 806. The pressure can be communicated to the second end 216 of the chamber 202 via the second port 810. The pressure provided by the air chamber device 800 can provide pressure to the second end 216 of the chamber 202 for actuating the tool 222.

Figure 10:
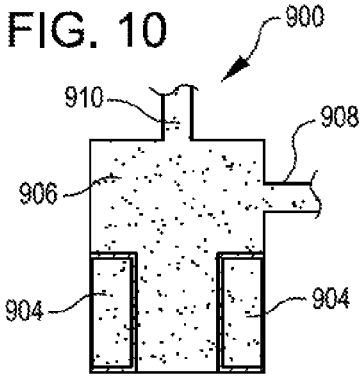
FIGS. 10-11 are schematic diagrams of a tube swelling chamber device for a pressure delay actuation assembly according to one aspect of the present disclosure.
Figure 11:
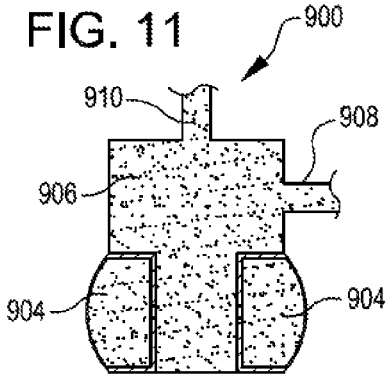

FIGS. 10-11 are schematic diagrams of a tube swelling chamber device 900 for a pressure delay actuation assembly 901 according to one aspect. The tube swelling chamber device 900 can be used as the energy storage device 208 discussed above with respect to FIG. 2. The tube swelling chamber device 900 can include a tube swelling chamber 904, a compartment 906, a first port 908 and a second port 910.

The tube swelling chamber 904 can be positioned in the compartment 906. The first port 908 can provide fluid communication between the compartment 906 and the pressure path 204. The second port 910 can provide fluid communication between the compartment 906 and the second end 216 of the chamber 202.

Pressure can be communicated from the pressure source 206 to the compartment 906 via the pressure path 204 and the first port 908. The pressure can be communicated into the tube swelling chamber 904. Pressure in the tube swelling chamber 904 can cause a volume expansion in the tube swelling chamber 904 (e.g., expansion from the position depicted in FIG. 10 to the position depicted in FIG. 11). The expanded volume in the tube swelling chamber 904 can store pressure energy in the tube swelling chamber 904. When pressure from the pressure source 206 is reduced, the pressure energy stored in the tube swelling chamber 904 can introduce pressure into the compartment 906 (e.g., contract from the position depicted in FIG. 11 to the position depicted in FIG. 10). The pressure can be communicated to the second end 216 of the chamber 202 via the second port 910. The pressure provided by the tube swelling chamber device 900 can provide pressure to the second end 216 of the chamber 202 for actuating the tool 222.

Figure 12:
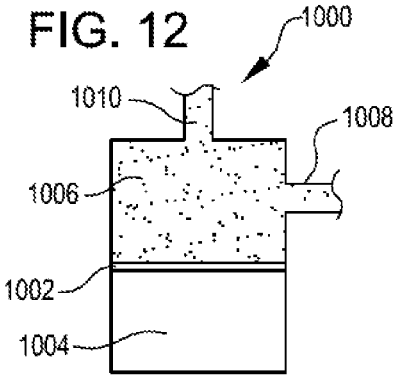
FIGS. 12-13 are schematic diagrams of a bladder device for a pressure delay actuation assembly according to one aspect of the present disclosure.
Figure 13:
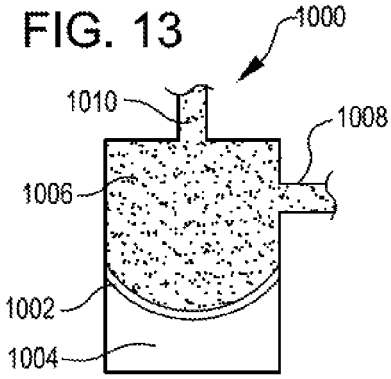

FIGS. 12-13 are schematic diagrams of a bladder device 1000 for a pressure delay actuation assembly 1001 according to one aspect. The bladder device 1000 can be used as the energy storage device 208 discussed above with respect to FIG. 2. The bladder device 1000 can include a bladder membrane 1002, a fluid chamber 1004, a compartment 1006, a first port 1008 and a second port 1010.

In some aspects, the bladder membrane 1002 can be a flexible plate, such as depicted in FIGS. 12-13. In other aspects, the bladder membrane 1002 can be configured as a crenulated structure or a corrugated structure, such as a bellows. The bladder membrane 1002 can be positioned in the compartment 1006. The bladder membrane 1002 can be positioned adjacent to the fluid chamber 1004. The first port 1008 can provide fluid communication between the compartment 1006 and the pressure path 204. The second port 1010 can provide fluid communication between the compartment 1006 and the second end 216 of the chamber 202.

Pressure can be communicated from the pressure source 206 to the compartment 1006 via the pressure path 204 and the first port 1008. The pressure can deflect the bladder membrane 1002 downward (e.g., from the position depicted in FIG. 12 to the position depicted in FIG. 13). Downward deflection of the bladder membrane 1002 can reduce a volume of the fluid chamber 1004 and increase a pressure in the fluid chamber 1004. Increasing a pressure in the fluid chamber 1004 can store energy in the fluid chamber 1004. For example, increasing the pressure can compress a gas or other compressible fluid in the fluid chamber 1004. The energy stored in the fluid chamber 1004 can deflect the bladder membrane 1002 in an upward direction (e.g., from the position depicted in FIG. 13 to the position depicted in FIG. 12) in response to pressure from the pressure source 206 being reduced. Upward deflection of the bladder membrane 1002 can increase pressure in the compartment 1006. The pressure can be communicated to the second end 216 of the chamber 202 via the second port 1010. The pressure provided by the bladder device 1000 can provide pressure to the second end 216 of the chamber 202 for actuating the tool 222.

In some aspects, a downhole assembly is provided. The downhole assembly can include a chamber, a pressure source, a pressure damper, and a member. The chamber can have a first end and a second end. The pressure source can be in fluid communication with the first end via a first pressure path and in fluid communication with the second end via a second pressure path. The pressure damper can be positioned in the second pressure path. The pressure damper can be operable for reducing a rate at which pressure is communicated via the second pressure path. The member can be positioned in the chamber between the first end and the second end. The member can be operable for actuating a downhole tool in response to a pressure difference between the first end and the second end. The pressure difference can result from a difference between a first rate of pressure communication and a second rate of pressure communication. The first rate of pressure communication can be a rate at which a pressure is communicated from the pressure source to the first end of the chamber via the first pressure path. The second rate of pressure communication can be a rate at which the pressure is communicated from the pressure source to the second end of the chamber via the second pressure path having the pressure damper.

In some aspects, a downhole assembly can be provided according to the following examples.

EXAMPLE #1

A downhole assembly can include a chamber, a pressure path; a pressure damper, a pressure source, and a member. The pressure path can be between a first end of the chamber and a second end of the chamber. The pressure damper can be positioned in the pressure path. The pressure damper can be operable for reducing a rate at which pressure is communicated in the pressure path. The pressure source can be in fluid communication with the pressure path and the pressure damper such that a pressure communicated from the pressure source is communicated to the first end of the chamber at a first rate different than a second rate that the pressure from the pressure source is communicated to the second end of the chamber. The member can be positioned in the chamber between the first end and the second end. The member can be operable for actuating a downhole tool in response to a pressure difference between the first end and the second end. The pressure difference can result from a difference in rates between the first rate and the second rate.

EXAMPLE #2

The downhole assembly of Example #1 can include an energy storage device in fluid communication with the second end of the chamber and the pressure path. The energy storage device can be operable for storing mechanical energy in response to the pressure communicated from the pressure source to the second end of the chamber via the pressure path.

EXAMPLE #3

The downhole assembly of any of Examples #1-2 can feature a pressure damper that includes a piston positioned in the pressure path such that fluid flow past the piston is prevented. The piston can have a first end in communication with the pressure source and a second end in communication with the second end of the chamber. The piston can be movable in response to the pressure communicated from the pressure source such that the piston communicates the pressure from the pressure source to the second end of the chamber. Friction between the piston and the pressure path can reduce a rate at which the piston moves, thereby reducing a rate at which pressure is communicated from the pressure source to the second end of the chamber.

EXAMPLE #4

The downhole assembly of any of Examples #1-3 can feature a pressure damper that includes a magnetic assembly coupled with the piston and arranged to provide magnetic fields operable to cause an eddy current in fluid in the pressure path. The rate at which the piston moves can be reduced in response to the eddy current.

EXAMPLE #5

A downhole assembly can include a member, a pressure source, a pressure path, an energy storage device, and a pressure damper. The member can be positioned in a chamber. The member can be positioned for actuating a downhole tool. The pressure source can be operatively coupled with a first end of the chamber for communicating a first pressure to a first end of the member. The pressure path can be from the first end of the chamber to a second end of the chamber. The energy storage device can be in fluid communication with the second end of the chamber and the pressure path. The energy storage device can be operable for storing mechanical energy in response to the first pressure being communicated to the energy storage device via the pressure path and operable for communicating a second pressure to a second end of the member in response to a reduction of the first pressure. The pressure damper can be positioned in the pressure path between the first end of the chamber and the second end of the chamber. The pressure damper can be operable for reducing a rate at which the first pressure is communicated to the energy storage device as compared to a rate at which the first pressure is communicated from the pressure source to a first end of the member.

EXAMPLE #6

The downhole assembly of any of Examples #1-5 can feature a member that includes at least one of a piston, a baffle, or a sliding sleeve.

EXAMPLE #7

The downhole assembly of any of Examples #1-6 can feature a pressure damper that includes at least one of a diameter restriction, a fluidic diode, or a portion of the pressure path having a rough surface.

EXAMPLE #8

The downhole assembly of any of Examples #1-7 can feature pressure damper that includes a barrier. The barrier can be positioned in the pressure path. The barrier can have a first end in communication with the pressure source and a second end in communication with the second end of the chamber. The barrier can be movable in response to the pressure communicated from the pressure source such that the barrier communicates the pressure from the pressure source to the second end of the chamber. A dissipative force between the barrier and the fluid path can reduce a rate at which the barrier moves. A rate at which pressure is communicated from the pressure source to the second end of the chamber can be reduced in response to the reduction in the rate at which the barrier moves.

EXAMPLE #9

The downhole assembly of any of Examples #1-8 can feature an energy storage device that includes an accumulator reservoir.

EXAMPLE #10

The downhole assembly of any of Examples #1-9 can feature an energy storage device that includes a piston biased by at least one spring.

EXAMPLE #11

The downhole assembly of any of Examples #1-10 can feature an energy storage device that includes a dual-spring piston assembly.

EXAMPLE #12

The downhole assembly of any of Examples #1-11 can feature an energy storage device that includes an air chamber.

EXAMPLE #13

The downhole assembly of any of Examples #1-12 can feature an energy storage device that includes a tube swelling chamber.

EXAMPLE #14

The downhole assembly of any of Examples #1-13 can feature an energy storage device that includes a bladder containing a compressible fluid.

EXAMPLE #15

The downhole assembly of any of Examples #1-14 can feature a downhole tool that includes at least one of a safety valve or a sliding sleeve.

EXAMPLE #16

The downhole assembly of any of Examples #1-15 can feature a second member, a second pressure path, a second energy storage device, and a second pressure damper. The second member can be positioned in a second chamber. The second member can be positioned for actuating a second downhole tool. The pressure source can be operatively coupled with a first end of the second chamber for communicating a first pressure to a first end of the second member. The second pressure path can be from the first end of the second chamber to a second end of the second chamber. The second energy storage device can be in fluid communication with the second end of the second chamber and the second pressure path. The second energy storage device can be operable for storing mechanical energy in response to the first pressure being communicated to the second energy storage device via the second pressure path. The second energy storage device can be operable for communicating a third pressure to a second end of the second member in response to a reduction of the first pressure. The second pressure damper can be positioned in the second pressure path between the first end of the second chamber and the second end of the second chamber. The second pressure damper can be operable for reducing a rate at which the first pressure is communicated to the second energy storage device as compared to a rate at which the first pressure is communicated from the pressure source to a first end of the second member. At least one of the second member, the second chamber, the second pressure path, the second energy storage device, or the second pressure damper can be sized such that the second downhole tool is actuated in response to the pressure communicated from the pressure source at a different time than the downhole tool is actuated in response to the pressure communicated from the pressure source.

EXAMPLE #17

A downhole assembly can include a piston, a pressure source, a pressure path, an accumulator, and a weep valve. The piston can be positioned in a chamber and operable for actuating a downhole tool. The pressure source can be coupled with a first end of the chamber and operable for communicating a first pressure to a first end of the piston. The pressure path can be from the pressure source at the first end of the chamber to a second end of the chamber. The accumulator can be in fluid communication with the second end of the chamber and the pressure path. The accumulator can be operable for storing mechanical energy in response to the first pressure being communicated to the accumulator via the pressure path. The accumulator can be operable for communicating at least some of the stored mechanical energy as a second pressure to a second end of the piston in response to a reduction of the first pressure. The weep valve can be positioned in the pressure path between the first end of the chamber and the second end of the chamber. The weep valve can be operable for reducing a rate at which the first pressure is communicated to the accumulator as compared to a rate at which the first pressure is communicated from the pressure source to the first end of the piston.

EXAMPLE #18

The downhole assembly of any of Examples #1-17 can feature a piston that is movable from the first end of the chamber in response to the first pressure being communicated to the first end of the piston and couplable to the downhole tool. The downhole tool can be actuated in response to movement of the piston.

EXAMPLE #19

The downhole assembly of any of Examples #1-18 can feature a piston that is movable from the second end of the chamber in response to the second pressure being communicated to the second end of the piston and couplable to the downhole tool. The downhole tool can be actuated in response to movement of the piston.

EXAMPLE #20

The downhole assembly of any of Examples #1-19 can feature a weep valve that is operable for reducing a rate at which the second pressure is communicated from the accumulator via the pressure path as compared to a rate at which the second pressure is communicated from the accumulator to the second end of the piston.

The foregoing description of the aspects, including illustrated examples, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A downhole assembly comprising:

a structure defining a chamber; and a pressure path between a first end of the chamber and a second end of the chamber;

a pressure damper positioned in the pressure path, the pressure damper operable for reducing a rate at which pressure is communicated in the pressure path;

a pressure source external to the chamber and in fluid communication with the pressure path and the pressure damper such that a pressure communicated from the pressure source is communicated to the first end of the chamber at a first rate different than a second rate that the pressure from the pressure source is communicated to the second end of the chamber; and a member positioned in the chamber between the first end and the second end, the member being operable for actuating a downhole tool in response to a pressure difference between the first end and the second end, the pressure difference resulting from a difference in rates between the first rate and the second rate, wherein the pressure path extends around the member and not through the member;

wherein the pressure damper comprises one of the following:

(a) a piston positioned in the pressure path such that fluid flow past the piston is prevented, the piston having a first end in communication with the pressure source and a second end in communication with the second end of the chamber, the piston moveable in response to the pressure communicated from the pressure source such that the piston communicates the pressure from the pressure source to the second end of the chamber, wherein friction between the piston and the pressure path reduces a rate at which the piston moves, thereby reducing a rate at which pressure is communicated from the pressure source to the second end of the chamber; or (b) a magnetic assembly coupled with the piston and arranged to provide magnetic fields operable to cause an eddy current in fluid in the pressure path, wherein the rate at which the piston moves is reduced in response to the eddy current.

2. The downhole assembly of claim 1, further comprising:

an energy storage device in fluid communication with the second end of the chamber and the pressure path, the energy storage device operable for storing mechanical energy in response to the pressure communicated from the pressure source to the second end of the chamber via the pressure path.

3. A downhole assembly comprising:

a member positioned in a chamber, the member positioned for actuating a downhole tool;

a pressure source external to the chamber and operatively coupled with a first end of the chamber for communicating a first pressure to a first end of the member;

a structure defining a pressure path from the first end of the chamber to a second end of the chamber, the pressure path extending around the member and not through the member;

an energy storage device in fluid communication with the second end of the chamber and the pressure path, the energy storage device operable for storing mechanical energy in response to the first pressure being communicated to the energy storage device via the pressure path and operable for communicating a second pressure to a second end of the member in response to a reduction of the first pressure;

a pressure damper positioned in the pressure path between the first end of the chamber and the second end of the chamber, the pressure damper operable for reducing a rate at which the first pressure is communicated to the energy storage device as compared to a rate at which the first pressure is communicated from the pressure source to a first end of the member:

wherein the energy storage device comprises one of the following:

(a) a dual-spring piston assembly;

(b) an air chamber;

(c) a tube swelling chamber; or (d) a bladder containing a compressible fluid.

4. The downhole assembly of claim 3, wherein the member comprises at least one of a piston, a baffle, or a sliding sleeve.

5. The downhole assembly of claim 3, wherein the pressure damper comprises at least one of a diameter restriction, a fluidic diode, or a portion of the pressure path having a rough surface.

6. The downhole assembly of claim 3, wherein the downhole tool comprises at least one of a safety valve or a sliding sleeve.

7. The downhole assembly of claim 3, further comprising:

a second member positioned in a second chamber, the second member positioned for actuating a second downhole tool, wherein the pressure source is operatively coupled with a first end of the second chamber for communicating a first pressure to a first end of the second member;

a second pressure path from the first end of the second chamber to a second end of the second chamber;

an second energy storage device in fluid communication with the second end of the second chamber and the second pressure path, the second energy storage device operable for storing mechanical energy in response to the first pressure being communicated to the second energy storage device via the second pressure path and operable for communicating a third pressure to a second end of the second member in response to a reduction of the first pressure;

a second pressure damper positioned in the second pressure path between the first end of the second chamber and the second end of the second chamber, the second pressure damper operable for reducing a rate at which the first pressure is communicated to the second energy storage device as compared to a rate at which the first pressure is communicated from the pressure source to a first end of the second member;

wherein at least one of the second member, the second chamber, the second pressure path, the second energy storage device, or the second pressure damper is sized such that the second downhole tool is actuated in response to the pressure communicated from the pressure source at a different time than the downhole tool is actuated in response to the pressure communicated from the pressure source.

8. A downhole assembly comprising:

a member positioned in a chamber, the member positioned for actuating a downhole tool;

a pressure source external to the chamber and operatively coupled with a first end of the chamber for communicating a first pressure to a first end of the member;

a structure defining a pressure path from the first end of the chamber to a second end of the chamber, the pressure path extending around the member and not through the member;

an energy storage device in fluid communication with the second end of the chamber and the pressure path, the energy storage device operable for storing mechanical energy in response to the first pressure being communicated to the energy storage device via the pressure path and operable for communicating a second pressure to a second end of the member in response to a reduction of the first pressure;

a pressure damper positioned in the pressure path between the first end of the chamber and the second end of the chamber, the pressure damper operable for reducing a rate at which the first pressure is communicated to the energy storage device as compared to a rate at which the first pressure is communicated from the pressure source to a first end of the member;

wherein the pressure damper comprises:

a barrier positioned in the pressure path, the barrier having a first end in communication with the pressure source and a second end in communication with the second end of the chamber, the barrier movable in response to the pressure communicated from the pressure source such that the barrier communicates the pressure from the pressure source to the second end of the chamber;

wherein a dissipative force between the barrier and the fluid path reduces a rate at which the barrier moves; and wherein a rate at which pressure is communicated from the pressure source to the second end of the chamber is reduced in response to the reduction in the rate at which the barrier moves.

9. The downhole assembly of claim 8, wherein the energy storage device comprises an accumulator reservoir.

10. The downhole assembly of claim 8, wherein the energy storage device comprises a piston biased by at least one spring.

11. A downhole assembly comprising:

a piston positioned in a chamber and operable for actuating a downhole tool;

a pressure source coupled with a first end of the chamber and operable for communicating a first pressure to a first end of the piston;

a pressure path from the pressure source at the first end of the chamber to a second end of the chamber;

an accumulator in fluid communication with the second end of the chamber and the pressure path, the accumulator operable for storing mechanical energy in response to the first pressure being communicated to the accumulator via the pressure path and operable for communicating at least some of the stored mechanical energy as a second pressure to a second end of the piston in response to a reduction of the first pressure;

a weep valve positioned in the pressure path between the first end of the chamber and the second end of the chamber, the weep valve operable for reducing a rate at which the first pressure is communicated to the accumulator as compared to a rate at which the first pressure is communicated from the pressure source to the first end of the piston.

12. The downhole assembly of claim 11, wherein the piston is movable from the first end of the chamber in response to the first pressure being communicated to the first end of the piston and couplable to the downhole tool, wherein the downhole tool is actuated in response to movement of the piston.

13. The downhole assembly of claim 11, wherein the piston is movable from the second end of the chamber in response to the second pressure being communicated to the second end of the piston and couplable to the downhole tool, wherein the downhole tool is actuated in response to movement of the piston.

14. The downhole assembly of claim 11, wherein the weep valve is further operable for reducing a rate at which the second pressure is communicated from the accumulator via the pressure path as compared to a rate at which the second pressure is communicated from the accumulator to the second end of the piston.

* * * * *